US006635981B2

(12) United States Patent
Tani et al.

(10) Patent No.: US 6,635,981 B2
(45) Date of Patent: Oct. 21, 2003

(54) COLOR CATHODE RAY TUBE WITH MASK FRAME HAVING BEADS FOR RIGIDITY

(75) Inventors: Munechika Tani, Konosu (JP); Naoyuki Makino, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 29 days.

(21) Appl. No.: 09/916,590

(22) Filed: Jul. 30, 2001

(65) Prior Publication Data

US 2002/0024282 A1 Feb. 28, 2002

(30) Foreign Application Priority Data

Jul. 31, 2000 (JP) ..... 2000-230923
Jul. 17, 2001 (JP) ..... 2001-216986

(51) Int. Cl.[7] ..... H01J 29/07
(52) U.S. Cl. ..... 313/407; 313/402; 313/410
(58) Field of Search ..... 313/407, 402–406

(56) References Cited

U.S. PATENT DOCUMENTS 5,248,914 A * 9/1993 Capek et al. ..... 313/402
5,576,595 A * 11/1996 Inoue ..... 313/402
5,698,938 A * 12/1997 Kim et al. ..... 313/407

FOREIGN PATENT DOCUMENTS

EP 895271 A1 * 2/1999 ..... H01J/29/07
JP 6-44919 2/1994
JP 2996912 10/1999

* cited by examiner

*Primary Examiner*—Nimeshkumar D. Patel
*Assistant Examiner*—Sikha Roy
(74) *Attorney, Agent, or Firm*—Oblon, Spivak, McClelland, Maier & Neustadt, P.C.

(57) ABSTRACT

A mask frame comprises a sidewall portion in the form of a rectangular frame including a pair of long sidewalls opposed to each other, a pair of short sidewalls opposed to each other, and corner sidewalls between the long and short sidewalls, and a base portion extending from the sidewall portion toward the center of the rectangular frame. The base portion has beads located near the corner sidewalls and connecting the long and short sidewalls.

20 Claims, 7 Drawing Sheets

| | Load bearing factor (kg/mm) | Diagonal apertune (mm) | Side wall height (mm) | Bead width (mm) |
|---|---|---|---|---|
| Prior art | 1.482 | 500 | 60 | —— |
| First embodiment | 1.711 | 544 | 53 | 15 |
| Second embodiment | 2.013 | 544 | 53 | 15 |
| Third embodiment | 2.354 | 544 | 53 | ※ 15~23 |

※ Minimum Width:15mm
Maximum Width:23mm

FIG. 12

COLOR CATHODE RAY TUBE WITH MASK FRAME HAVING BEADS FOR RIGIDITY

CROSS-REFERENCE TO RELATED APPLICATIONS

This application is based upon and claims the benefit of priority from the prior Japanese Patent Applications No. 2000-230923, filed Jul. 31, 2000; and No. 2001-216986, filed Jul. 17, 2001, the entire contents of both of which are incorporated herein by reference.

BACKGROUND OF THE INVENTION

1. Field of the Invention

The present invention relates to a color cathode ray tube of a shadow-mask type and a mask frame used in the same.

2. Description of the Related Art

In a color cathode ray tube of a shadow-mask type that is presently in wide use, a shadow mask for use as a color sorting mechanism comprises a rectangular mask body formed having a large number of electron beam holes and a rectangular mask frame supporting the mask body. In order to display an image free from color drift on a phosphor screen, three electron beams having passed through the electron beam holes must be landed correctly on their corresponding three-color phosphor layers. To attain this, the shadow mask must be held in a correct position relative to a panel. The shadow mask can be removably supported inside the panel in a manner such that elastic supporters that attached to corner sidewalls of the mask frame are engaged with stud pins on a skirt portion of the panel.

In order to meet the requirement for higher resolution to cope with the modern development of multimedia systems, the arrangement pitch of three-color phosphor layers of a phosphor screen is shortened. Accordingly, the tolerance for beam landing is so small that color drift easily occurs. Thus, the beam landing requires higher accuracy.

On the other hand, as modern color cathode ray tubes become larger in size, because of an increasing demand, mask frames accordingly become heavier.

Further, consideration must be given to impact that acts on a color cathode ray tube during its manufacture or transportation. The color cathode ray tube is provided with elastic supporters that can absorb external impact applied thereto. If the impact resistance of the elastic supporters is increased so that the supporters can support the heavy mask frame without causing dislocation under the external impact, the mask frame may possibly be deformed, failing to stand force that acts thereon as the shadow mask is loaded or unloaded during the manufacture of the color cathode ray tube. If the mask frame is deformed, the shadow mask that is fixed with it may possibly be deformed and dislocated with respect to the panel.

Accordingly, the mask frame is expected to be enhanced in strength without gaining weight. As an example of a measure to meet this requirement, there is proposed a method in which recesses are formed ranging from the sidewall portion of the mask frame to the base. In order to improve the rigidity of a mask frame 1A against torsion around its diagonal axis (axis D), the mask frame 1A is provided with recesses 4 near its corners, which connect sidewalls 2 and a base 3, as shown in FIGS. 7A and 7B, for example.

In the mask frame structure shown in FIGS. 7A and 7B, however, each recess 4 is provided ranging from the sidewall 2 at each corner end portion to the base 3, so that the diagonal dimension of the mask frame 1A varies substantially from a desired value. If the diagonal dimension of the mask frame 1A is smaller than the desired value, then its variation prevents a mask body 1B from being held in the mask frame 1A when the mask body 1B is welded to the mask frame 1A. If the diagonal dimension of the mask frame 1A is larger than the desired value, then the mask body 1B is pulled and easily deformed during the mask welding operation.

These problems are particularly significant for a color cathode ray tube that is provided with a shadow mask having a substantially flat curved surface or a flat face panel of which the curvature radius of the outer surface is substantially infinite.

Described in Jpn. Pat. Appln. KOKAI Publication No. 6-44919, on the other hand, is a structure that is provided with an annular cross bead 8 in a base 7 of a mask frame 5 and longitudinal beads 9 that extend from the cross bead 8 toward a frame sidewall 6, as shown in FIG. 8.

In general, residual stress (strain) is generated in the material of a press-formed mask frame. Normally, this residual stress is removed in a heat treatment process. In the case where the bead 8 is formed surrounding the opening of the mask frame 5, as shown in FIG. 8, however, deformation may possibly be caused along the bead 8 as the residual stress is removed during the heat treatment process. This deformation influences the shapes of the sidewall and the opening of the mask frame 5. Long and short side portions of the sidewall are lower in rigidity than corner portions, and deformation of the sidewall results in deformation of the mask body.

If the opening of the mask frame 5 is deformed toward the phosphor screen or in a manner such that it practically narrows, then the electron beams are unduly blocked, so that non-luminous regions are formed inevitably. If the opening of the mask frame 5 is deformed toward the electron gun or in a manner such that is practically widens, on the other hand, then the electron beams are blocked inadequately, so that unnecessary light emission is caused.

BRIEF SUMMARY OF THE INVENTION

The present invention has been contrived in consideration of these circumstances, and its object is to provide a mask frame, capable of maintaining torsional rigidity without increasing weight and of restraining deformation of a mask body, and a color cathode ray tube provided with the mask frame.

According to the present invention, there is provided a color cathode ray tube comprising: a vacuum envelope including a panel having a major axis and a minor axis perpendicular to each other; a phosphor screen located on the inner surface of the panel; an electron gun assembly for emitting electron beams toward the phosphor screen; and a color sorting mechanism opposed to the phosphor screen, the color sorting mechanism including a mask body, having a rectangular effective portion with a large number of electron beam holes, and a mask frame fixedly fitted with the mask body, the mask frame including a sidewall portion, composed of a pair of long sidewalls extending parallel to the major axis and opposed to each other, a pair of short sidewalls extending parallel to the minor axis and opposed to each other, and corner sidewalls between the long and short sidewalls, and a base portion extending from the sidewall portion toward a tube axis, the base portion having substantially straight beads located near the corner sidewalls and connecting the long and short sidewalls.

According to the present invention, moreover, there is provided a mask frame comprising: a sidewall portion in the form of a rectangular frame including a pair of long sidewalls opposed to each other, a pair of short sidewalls opposed to each other, and corner sidewalls between the long and short sidewalls; and a base portion extending from the sidewall portion toward the center of the rectangular frame, the base portion having substantially straight beads located near the corner sidewalls and connecting the long and short sidewalls.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiments of the invention, and together with the general description given above and the detailed description of the embodiments given below, serve to explain the principles of the invention.

FIG. 12 is a discharge showing results of comparison between the respective load bearing factors of the mask frames according to the individual embodiments and the conventional mask frame.

DETAILED DESCRIPTION OF THE INVENTION

A mask frame according to an embodiment of the present invention and a color cathode ray tube provided with the same.

Figure 1:
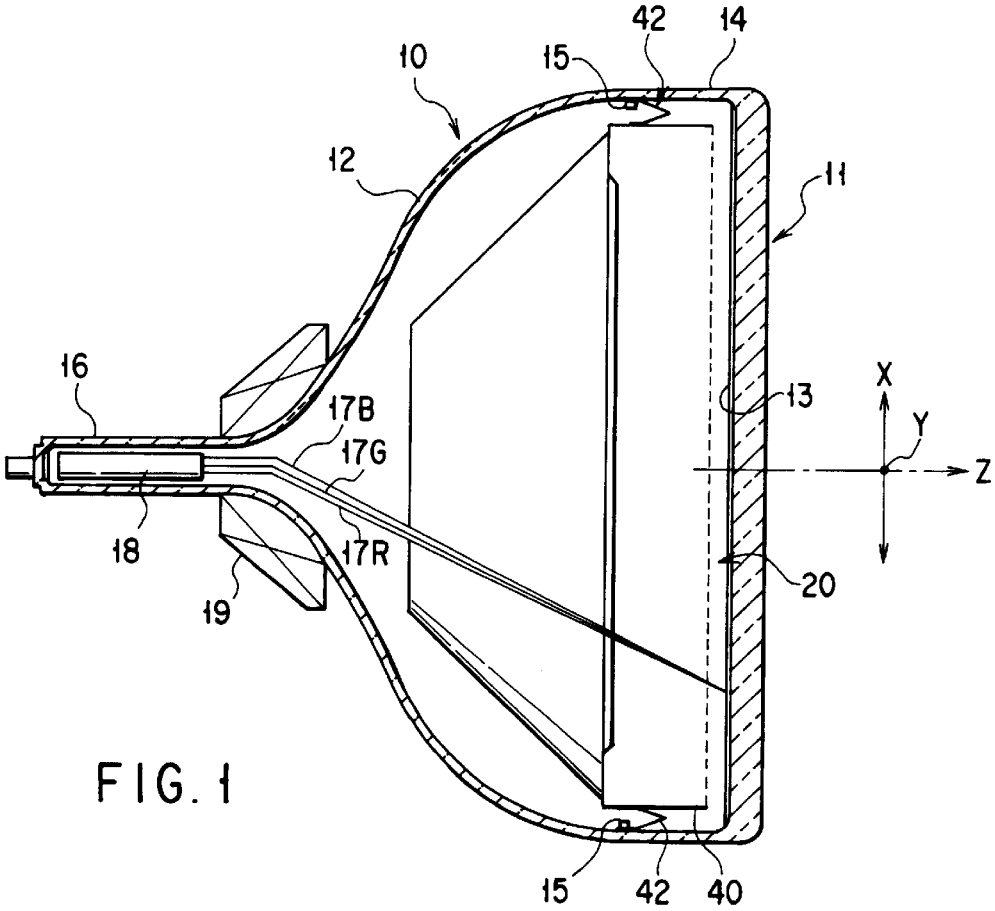
FIG. 1 is a horizontal sectional view schematically showing the construction of a color cathode ray tube according to an embodiment of the present invention.

As shown in FIG. 1, the cathode ray tube or color cathode ray tube according to the one embodiment of the invention is of a 29-inch type with a screen aspect ratio of 4:3 (effective diagonal dimension of the screen: 68 cm) that is used in a TV set or the like. The outer surface of the panel of the apparatus has a curvature such that it is nearly perfectly flat.

This color cathode ray tube, which has a horizontal axis (X-axis) as a major axis and a vertical axis (Y-axis) as a minor axis, comprises a vacuum envelope 10 formed of a rectangular panel 11 having a long side that extends in the direction of the X-axis and a short side that extends in the direction of the Y-axis, and a funnel 12 that is connected to an end portion of the panel 11. A phosphor screen 13 is provided on a rectangular effective region of the inner surface of the panel 11. The screen 13 includes a large number of stripe-shaped (or dot-like) three-color phosphor layers that glow red (R), green (G), and blue (B), individually, and black stripe-shaped light absorbing layers that are arranged individually in gaps between the phosphor layers.

A shadow mask 20 for use as a color sorting mechanism is located at a given space in the direction of the tube axis (Z-axis) from the phosphor screen 13 in the panel 11. The mask 20 is supported inside the panel 11 in a manner such that a plurality of elastic supporters 42 on the outer wall of a mask frame 40 (mentioned later) individually engage a plurality of stud pins 15 that are embedded in a sidewall 14 of the panel 11.

Further, an in-line electron gun assembly 18 is located in a cylindrical neck portion 16 of the funnel 12. The assembly 18 emits three electron beams 17B, 17G and 17R that are arranged on the horizontal axis (X-axis). The three electron beams 17B, 17G and 17R that are emitted from the electron gun assembly 18 are incident at different angles upon electron beam holes of the shadow mask 20, they land individually on the target phosphor layers, thereby causing the layers to glow in the given colors.

A deflection yoke 19 is located around a region near the joint of the neck portion 16 of the funnel 12. The yoke 19 generates a non-uniform deflecting magnetic field that deflects the electron beams 17B, 17B and 17R from the electron gun assembly 18 in the directions of the horizontal and vertical axes. This non-uniform deflecting magnetic field is formed of a horizontal deflecting magnetic field of a pincushion type and a vertical deflecting magnetic field of a barrel type.

The three electron beams 17B, 17G and 17R that are emitted from the electron gun assembly 18 self-converge toward the phosphor screen 13 as they are focused on their corresponding phosphor layers on the screen 13. Further, the three electron beams 17B, 17G and 17R are deflected by means of the non-uniform deflecting magnetic field and used to scan the phosphor screen 13 on the inner surface of the panel 11 in the directions of the horizontal and vertical axes. Thereupon, a color image is displayed.

Figure 2:
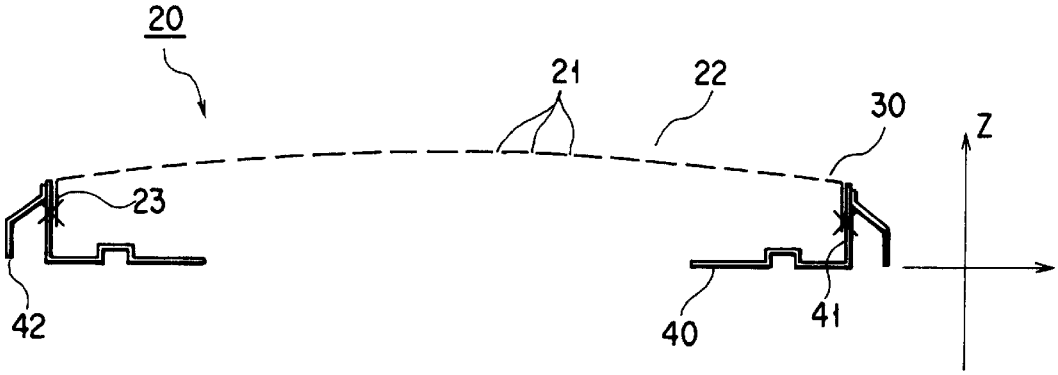
FIG. 2 is a sectional view schematically showing a cross section of a shadow mask assembly of the color cathode ray tube shown in FIG. 1 along a diagonal axis thereof.

FIG. 2 shows a profile of the shadow mask 20, and FIGS. 3, 4A, 4B and 4C show the construction of the mask frame 40. The shadow mask 20 is composed of a mask body 30 and the mask frame 40.

The mask body 30 includes a rectangular effective portion 22, which has a large number of electron beam holes 21 arranged at given pitches in the directions of the horizontal axis (X-axis) and the vertical axis (Y-axis), and a skirt portion 23 that is bent from the periphery of the effective portion 22 and extends in the direction of the tube axis (Z-axis). The mask body 30 is formed by press-forming a metal sheet of a low-expansion material, such as invar (alloy of 36%-Ni and Fe, coefficient of thermal expansion: $1.2\times 10^{-6}/°$ C.), into a given shape. The mask frame 40 is a rectangular frame having an L-shaped cross section and fixedly supports the mask body 30. The mask frame 40 is formed of a material having a coefficient of thermal expansion higher than that of the material of the mask body 30, e.g., a low-carbon steel sheet (coefficient of thermal expansion: $12\times 10^{-6}/°$ C.).

The effective portion 22 of the mask body 30 is formed in the shape of a predetermined curved surface, and has a long side extending in the direction of the horizontal axis (X-axis) and a short side extending in the direction of the vertical axis (Y-axis). The skirt portion 23 is fixedly welded to the inside of a sidewall 41 of the rectangular mask frame 40 at a plurality of spots (indicated by X in FIG. 2). In this embodiment, the skirt portion 23 of the mask body 30 is fixed to the mask frame 40 in a manner such that it is subjected to some compressive stress toward the center (tube axis side), and the bulging strength of the curved surface is enhanced by means of the compressive stress.

The elastic supporters 42 are provided outside the mask frame 40, and the shadow mask 20 is located in the panel 11 in a manner such that openings in the supporters 42 individually engage the stud pins 15 on the inner surface of the panel 11. Further, the mask frame 40 is provided with beads (recesses, mentioned later) in its base. The skirt portion 23 of the mask body 30 extends in the direction of the tube axis (Z-axis) from the bent portion around the effective portion 22, and its end portion is open.

The construction of a mask frame according to a first embodiment will now be described in detail with reference to FIGS. 3, 4A, 4B and 4C.

The mask frame 40 includes the sidewall portion 41 and a base portion 43 that extends from the sidewall portion 41 toward the tube axis (Z-axis), and is in the form of a rectangular frame having a substantially L-shaped cross section. The sidewall portion 41 includes a pair of long sidewalls 41*a* and 41*b* that extend parallel to the major axis (X-axis) and are opposed to each other, a pair of short sidewalls 41*c* and 41*d* that extend parallel to the minor axis (Y-axis) and are opposed to each other, and corner sidewalls 41*e* to 41*h* between the long sidewalls 41*a* and 41*b* and the short sidewalls 41*c* and 41*d*. The base portion 43 has a large opening 45 through which the deflected electron beams can pass. Each of the corner sidewalls 41*e* to 41*h* has a flat outer surface, which is provided with an elastic supporter in engagement with each corresponding stud pin 15 embedded in the sidewall 14 of the panel 11.

Figure 11A:
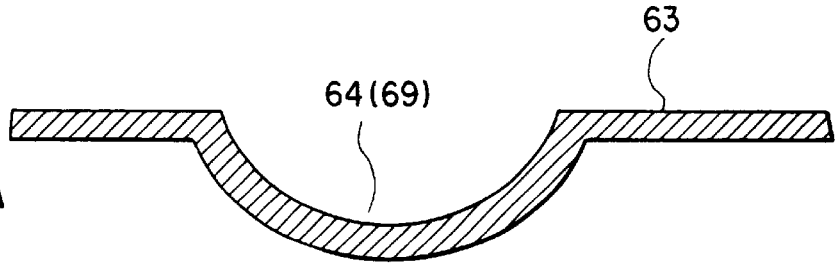
FIGS. 11A to 11D are views individually showing examples of the cross sections of beads formed in the base of the mask frame of the shadow mask assembly.
Figure 11B:
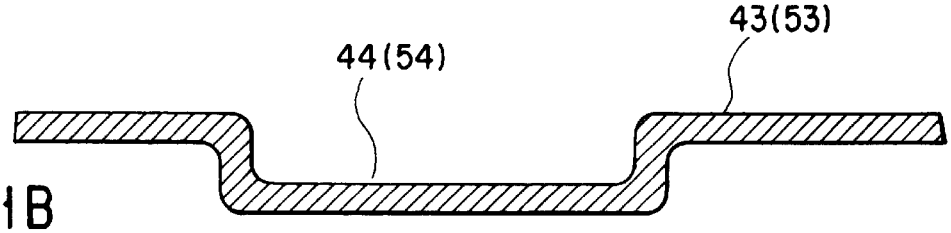

Substantially straight beads 44*a* to 44*d* are provided individually near the corners of the base portion 43. They continuously linearly connect the long sidewalls 41*a* and 41*b* and the short sidewalls 41*c* and 41*d*, with each corner sidewall 41*e* to 41*h* positioned between the long sidewall and the adjacent short sidewall. As shown in FIG. 11B, for example, the beads 44*a* to 44*d* have a rectangular cross section. For example, the width and depth of the beads 44*a* to 44*d* are 15 mm and 2 mm, respectively. In the base portion 43 according to this first embodiment, only the beads 44*a* to 44*d* are recessed, and other regions are substantially flush with one another.

The longitudinal directions or extending directions of the beads 44*a* to 44*d* are substantially perpendicular to diagonal axes D (D1 and D2) that pass through the corner sidewalls 41*e* to 41*h* near the beads 44*a* to 44*d*. In this embodiment, however, the longitudinal directions of the beads and the diagonal axes D are not perfectly perpendicular to one another. Thus, the longitudinal directions of the beads are not parallel to lines that are normal to the diagonal axes D.

The mask frame structure according to the first embodiment has the following rigidity.

Figure 3:
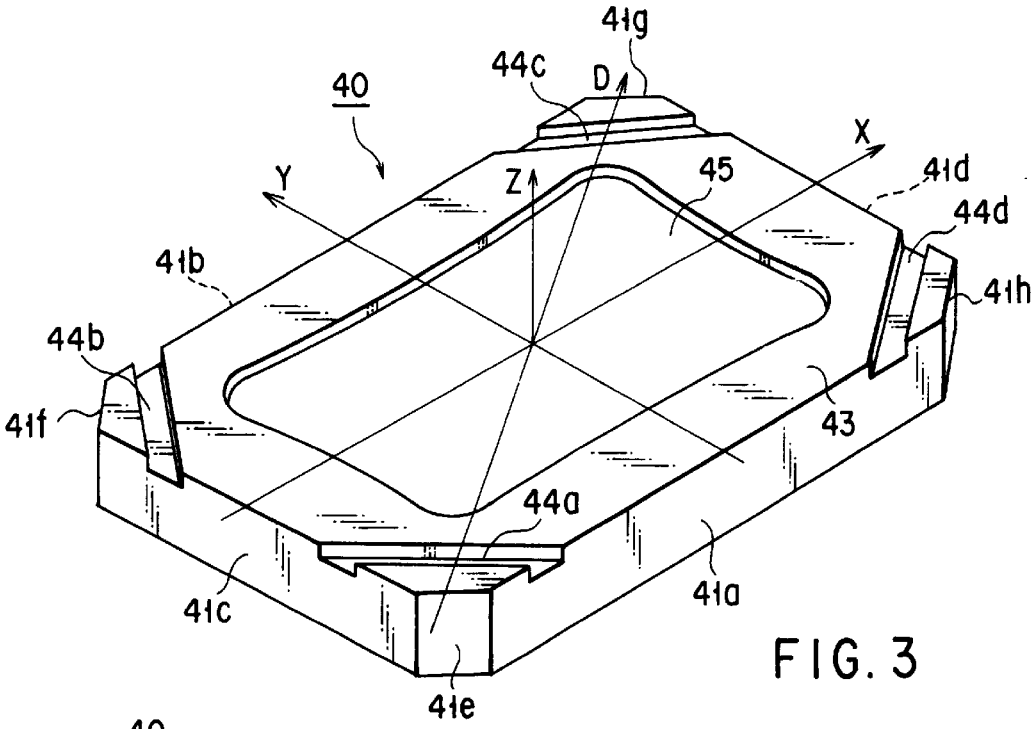
FIG. 3 is a perspective view schematically showing the construction of the base of a mask frame of the shadow mask assembly shown in FIG. 2.
Figure 4A:
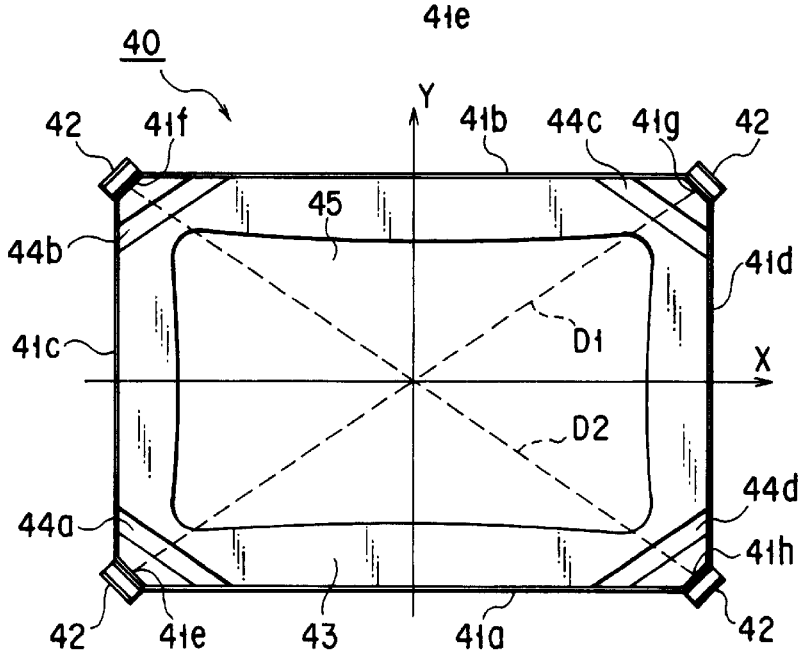
FIG. 4A is a plan view schematically showing the construction of the base of the mask frame shown in FIG. 3.
Figure 4C:
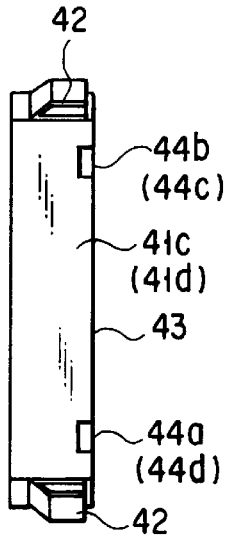
FIG. 4C is a plan view schematically showing the construction of the short side of the mask frame shown in FIG. 3.
Figure 4B:
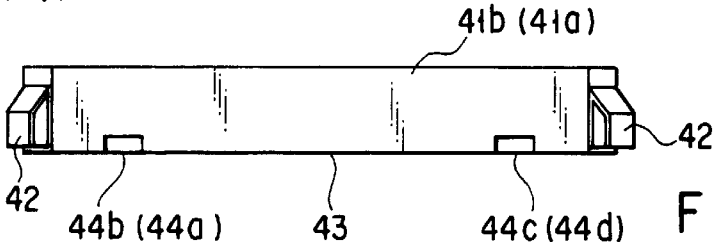
FIG. 4B is a plan view schematically showing the construction of the long side of the mask frame shown in FIG. 3.

A prior art example for comparison is a mask frame that, unlike the mask frame of the first embodiment shown in FIG. 3, is not provided with any beads. In this case, displacement (hereinafter referred to as load bearing factor) was evaluated for the case where a force of 1 kg was applied to one corner with the three other corners fixed. The thickness and diagonal dimension of the mask frame were 1 mm and 663 mm, respectively.

FIG. 12 shows results of the evaluation. As shown in FIG. 12, the load bearing factor of the conventional mask frame without beads is 1.482 kg/mm, while that of the mask frame according to the first embodiment is 1.711 kg/mm.

As seen from these results, the mask frame according to the first embodiment can enjoy a higher load bearing factor than the conventional mask frame can, despite the lower sidewall and the greater diagonal diameter of the opening. Accordingly, the quantity of material used for the formation of the mask frame can be lessened, so that the cost can be lowered, and the weight of the mask frame can be reduced.

Thus, the beads on the mask frame shown in FIG. 3 serve to secure satisfactory rigidity without increasing the weight. In consequence, the mask body can be prevented from being deformed by stress or load that acts on the mask frame.

The construction of a mask frame 50 according to a second embodiment will now be described in detail with reference to FIGS. 5, 6A, 6B and 6C.

The mask frame 50 includes a sidewall portion 51 and a base portion 53 that extends from the sidewall portion 51 toward the tube axis (Z-axis), and is in the form of a rectangular frame having a substantially L-shaped cross section. The sidewall portion 51 includes a pair of long sidewalls 51*a* and 51*b* that extend parallel to the major axis (X-axis) and are opposed to each other, a pair of short sidewalls 51*c* and 51*d* that extend parallel to the minor axis (Y-axis) and are opposed to each other, and corner sidewalls 51*e* to 51*h* between the long sidewalls 51*a* and 51*b* and the short sidewalls 51*c* and 51*d*. The base portion 53 has a large opening 55 through which the deflected electron beams can pass.

Substantially straight beads 54*a* to 54*d* are provided individually near the corners of the base portion 53. They continuously linearly connect the long sidewalls 51*a* and 51*b* and the short sidewalls 51*c* and 51*d*, with each corner sidewall 51*e* to 51*h* positioned between the long sidewall and the adjacent short sidewall. As shown in FIG. 11B, for example, the beads 54*a* to 54*d* have a rectangular cross section. For example, the width and depth of the beads 54*a* to 54*d* are 15 mm and 2 mm, respectively.

The longitudinal directions or extending directions of the beads 54*a* to 54*d* are substantially perpendicular to diagonal axes D (D1 and D2) that pass through the corner sidewalls 51*e* to 51*h* near the beads 54*a* to 54*d*. In this embodiment, however, the longitudinal directions of the beads and the diagonal axes D are not perfectly perpendicular to one another. Thus, the longitudinal directions of the beads are not parallel to lines that are normal to the diagonal axes D.

Figure 11C:
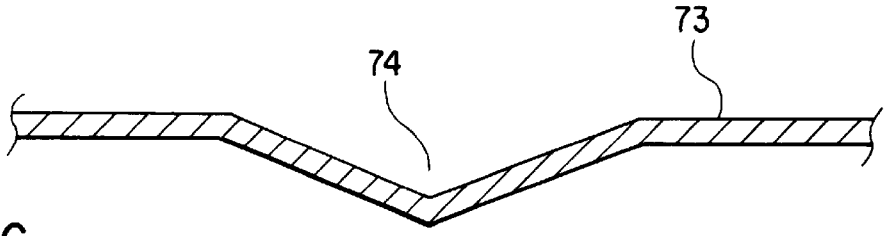
Figure 11D:
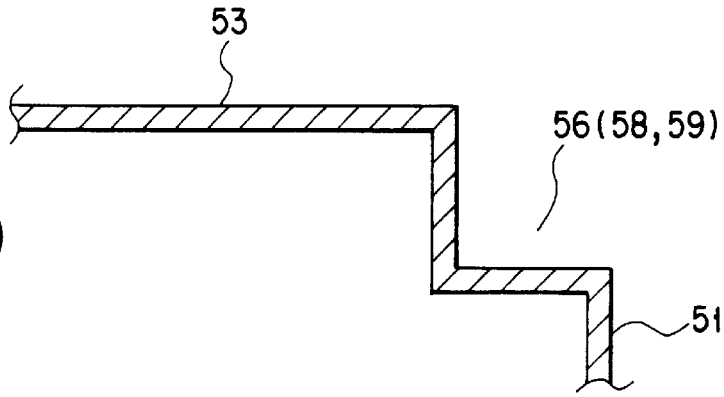

According to this second embodiment, moreover, beads 56*a*, 56*b*, 57*a* and 57*b* that are continuous with the sidewalls and the base portion 53 are also provided individually near the respective bases of the long sidewalls 51*a* and 51*b*. Further, beads 58 and 59 that are continuous with the sidewalls and the base portion 53 are provided individually near the respective bases of the short sidewalls 51*c* and 51*d*. As shown in FIG. 11D, these beads 56*a*, 56*b*, 57*a*, 57*b*, 58 and 59 have a substantially L-shaped cross section.

In this embodiment, the beads 54*a* to 54*d* that are formed near the corners have their respective end portions on the side of the sidewalls 51*e* to 51*h* connected to the beads 56*a*, 56*b*, 57*a*, 57*b*, 58 and 59 for sidewall reinforcement. The length of each of the beads 56*a*, 56*b*, 57*a* and 57*b* of the long sidewalls 51*a* and 51*b* along the horizontal axis (X-axis) is 22 mm, and the depth of each bead along the tube axis (Z-axis) is 7 mm, for example.

In the base portion 53 according to this second embodiment, only the beads 54*a* to 54*d*, 56*a*, 56*b*, 57*a*, 57*b*, 58 and 59 are recessed, and other regions are substantially flush with one another.

The mask frame structure according to the second embodiment has the following rigidity. As in the case of the first embodiment, the thickness and diagonal dimension of the mask frame were 1 mm and 663 mm, respectively.

FIG. 12 shows results of the evaluation. As shown in FIG. 12, the load bearing factor of the conventional mask frame without beads is 1.482 kg/mm, while that of the mask frame according to the second embodiment is 2.013 kg/mm.

As seen from these results, the mask frame according to the second embodiment can enjoy a higher load bearing factor than the conventional mask frame can, despite the lower sidewall and the greater diagonal diameter of the opening. The mask frame according to this second embodiment can enjoy a still higher load bearing factor than the mask frame of the first embodiment can. Accordingly, the quantity of material used for the formation of the mask frame can be lessened, so that the cost can be lowered, and the weight of the mask frame can be reduced.

Figure 5:
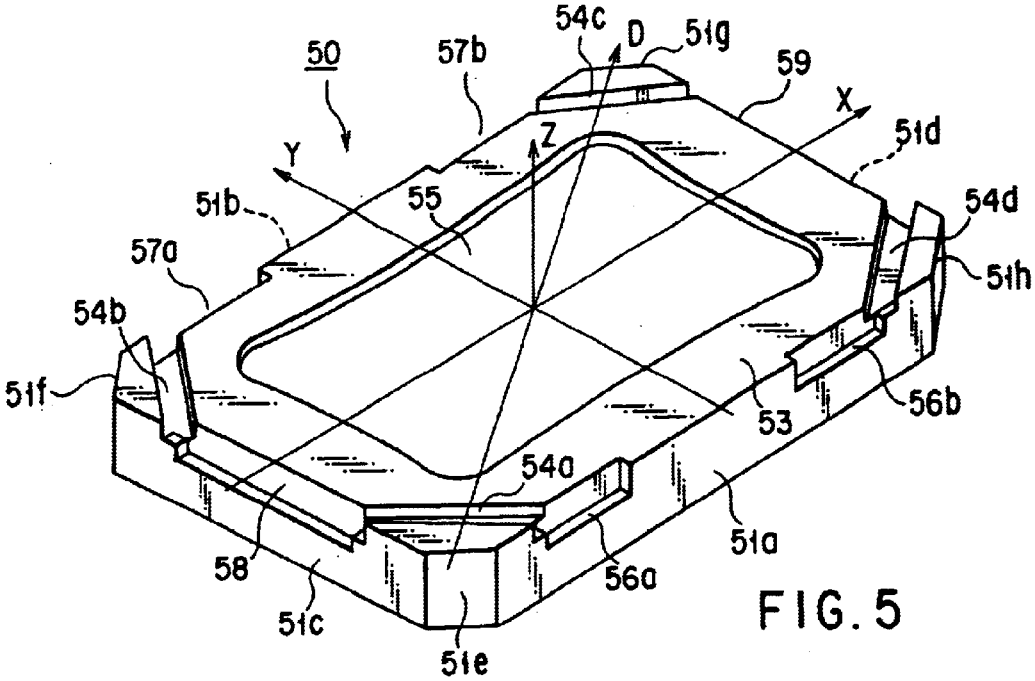
FIG. 5 is a perspective view schematically showing the construction of the base of a mask frame of a shadow mask assembly according to another embodiment of the invention.
Figure 6A:
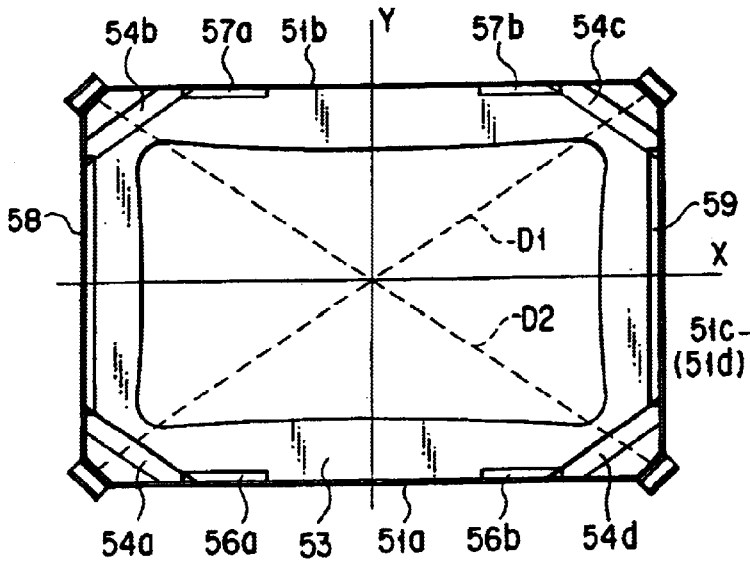
FIG. 6A is a plan view schematically showing the construction of the base of the mask frame shown in FIG. 5.
Figure 6C:
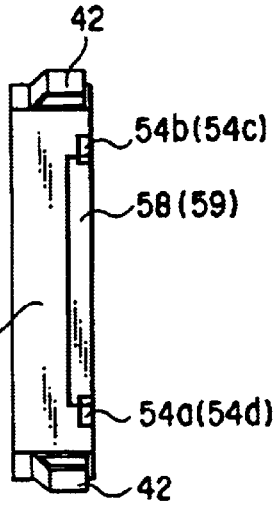
FIG. 6C is a plan view schematically showing the construction of the short side of the mask frame shown in FIG. 5.
Figure 6B:
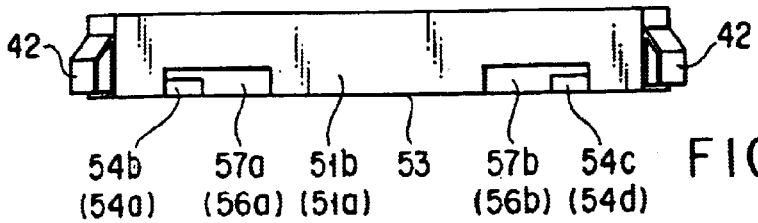
FIG. 6B is a plan view schematically showing the construction of the long side of the mask frame shown in FIG. 5.
Figure 7A:
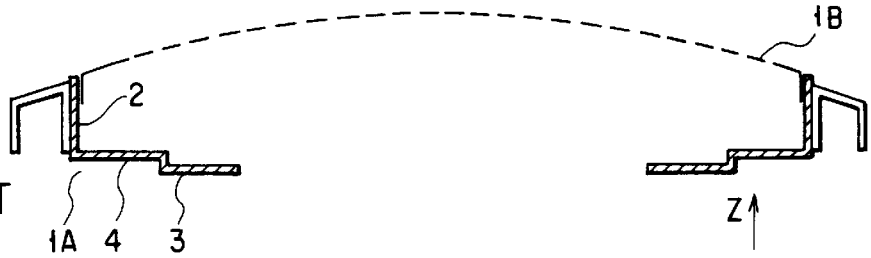
FIG. 7A PRIOR ART
FIG. 7A is a sectional view schematically showing a cross section of a conventional shadow mask assembly along a diagonal axis thereof.
Figure 7B:
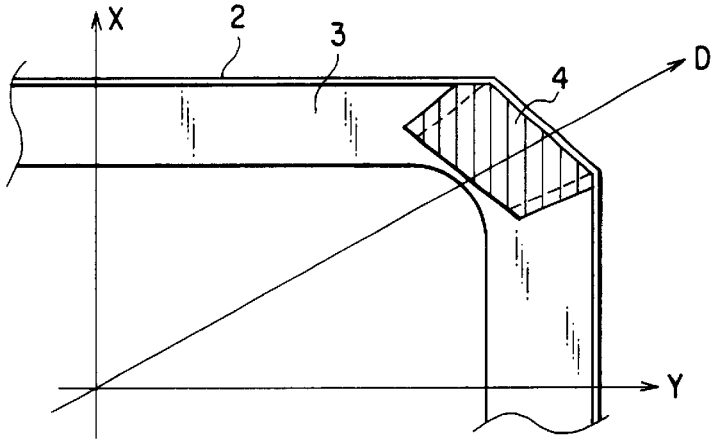
FIG. 7B PRIOR ART
FIG. 7B is a plan view schematically showing the construction of the base around a corner end portion of the shadow mask assembly shown in FIG. 7A.
Figure 8:
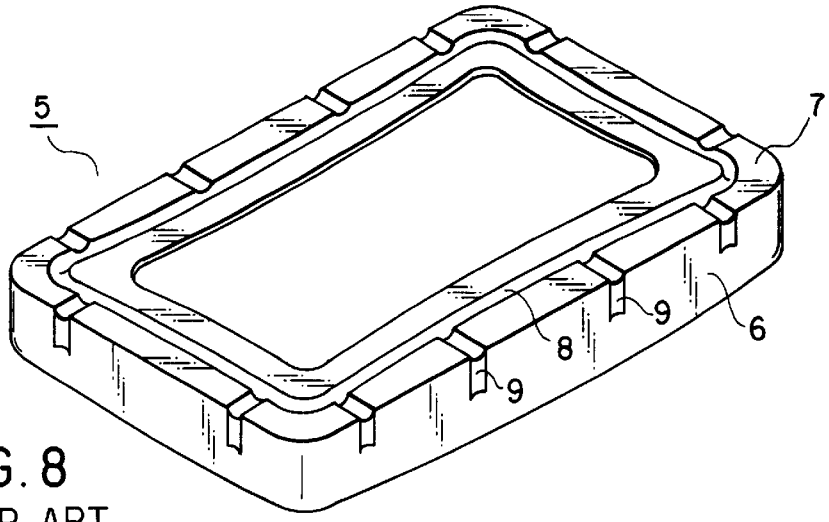
FIG. 8 PRIOR ART
FIG. 8 is a perspective view schematically showing the construction of the base of a mask frame of a conventional shadow mask assembly.

Thus, the beads on the mask frame shown in FIG. 5 serve to secure satisfactory rigidity without increasing the weight. In consequence, the mask body can be prevented from being deformed by stress or load that acts on the mask frame.

The construction of a mask frame 60 according to a third embodiment will now be described in detail with reference to FIG. 9.

The mask frame 60 includes a sidewall portion 61 and a base portion 63 that extends from the sidewall portion 61 toward the tube axis (Z-axis), and is in the form of a rectangular frame having a substantially L-shaped cross section. The sidewall portion 61 includes a pair of long sidewalls 61*a* and 61*b* that extend parallel to the major axis (X-axis) and are opposed to each other, a pair of short sidewalls 61*c* and 61*d* that extend parallel to the minor axis (Y-axis) and are opposed to each other, and corner sidewalls 61*e* to 61*h* between the long sidewalls 61*a* and 61*b* and the short sidewalls 61*c* and 61*d*. The base portion 63 has a large opening 65 through which the deflected electron beams can pass.

Substantially straight beads 64*a* to 64*d* are provided individually near the corners of the base portion 63. They continuously linearly connect the long sidewalls 61*a* and 61*b* and the short sidewalls 61*c* and 61*d*, with each corner sidewall 61*e* to 61*h* positioned between the long sidewall and the adjacent short sidewall. As shown in FIG. 11A, for example, the beads 64*a* to 64*d* have a U-shaped cross section.

The beads 64*a* to 64*d* are formed so that a bead width WD near the diagonal axis D1 (D2) is greater than a bead width WL on the long sidewalls 61*a* and 61*b* and a bead width WS on the short sidewalls 61*c* and 61*d*. The bead width WD near the diagonal axis is greater than the other widths. The frame strength can be improved more effectively by adjusting the width WD to about ½ of a diagonal portion width (width along the diagonal axis D) FWD of the base portion 63. In this third embodiment, the bead widths WL and WS are substantially the same minimum width of 15 mm, for example, and the bead width WD is a maximum width of 23 mm, for example. In this case, the diagonal portion width FWD of the base portion 63 is 46 mm, for example. The depth of the deepest portion of each bead is 2 mm.

The longitudinal directions or extending directions of the beads 64*a* to 64*d* are substantially perpendicular to diagonal axes D (D1 and D2) that pass through the corner sidewalls 61*e* to 61*h* near the beads 64*a* to 64*d*. In this embodiment, however, the longitudinal directions of the beads and the diagonal axes D are not perfectly perpendicular to one another. Thus, the longitudinal directions of the beads are not parallel to lines that are normal to the diagonal axes D.

In the base portion 63 according to this third embodiment, only the beads 64*a* to 64*d* are recessed, and other regions are substantially flush with one another.

The mask frame structure according to the third embodiment has the following rigidity. As in the case of the first embodiment, the thickness and diagonal dimension of the mask frame were 1 mm and 663 mm, respectively.

FIG. 12 shows results of the evaluation. As shown in FIG. 12, the load bearing factor of the conventional mask frame without beads is 1.482 kg/mm, while that of the mask frame according to the third embodiment is 2.354 kg/mm.

As seen from these results, the mask frame according to the third embodiment can enjoy a higher load bearing factor than the conventional mask frame can, despite the lower sidewall and the greater diagonal diameter of the opening. The mask frame according to this third embodiment can enjoy a still higher load bearing factor than the mask frame of the first embodiment can. Accordingly, the quantity of material used for the formation of the mask frame can be lessened, so that the cost can be lowered, and the weight of the mask frame can be reduced.

Figure 9:
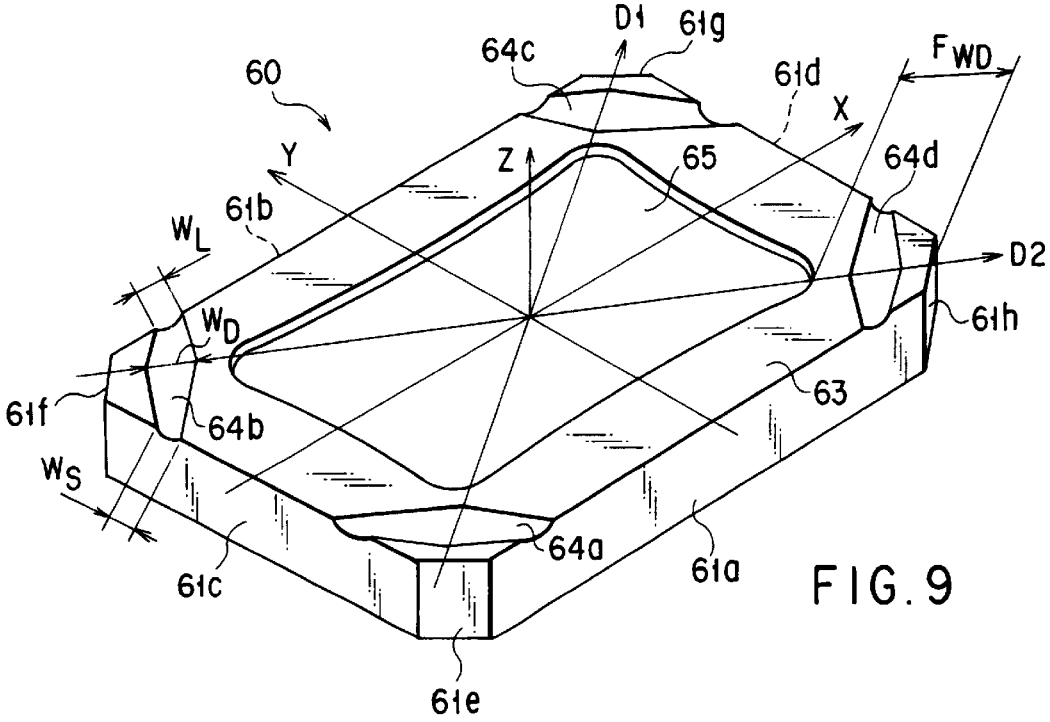
FIG. 9 is a perspective view schematically showing the construction of the base of a mask frame of a shadow mask assembly according to still another embodiment of the invention.

Thus, the beads on the mask frame shown in FIG. 9 serve to secure satisfactory rigidity without increasing the weight. In consequence, the mask body can be prevented from being deformed by stress or load that acts on the mask frame.

Figure 10:
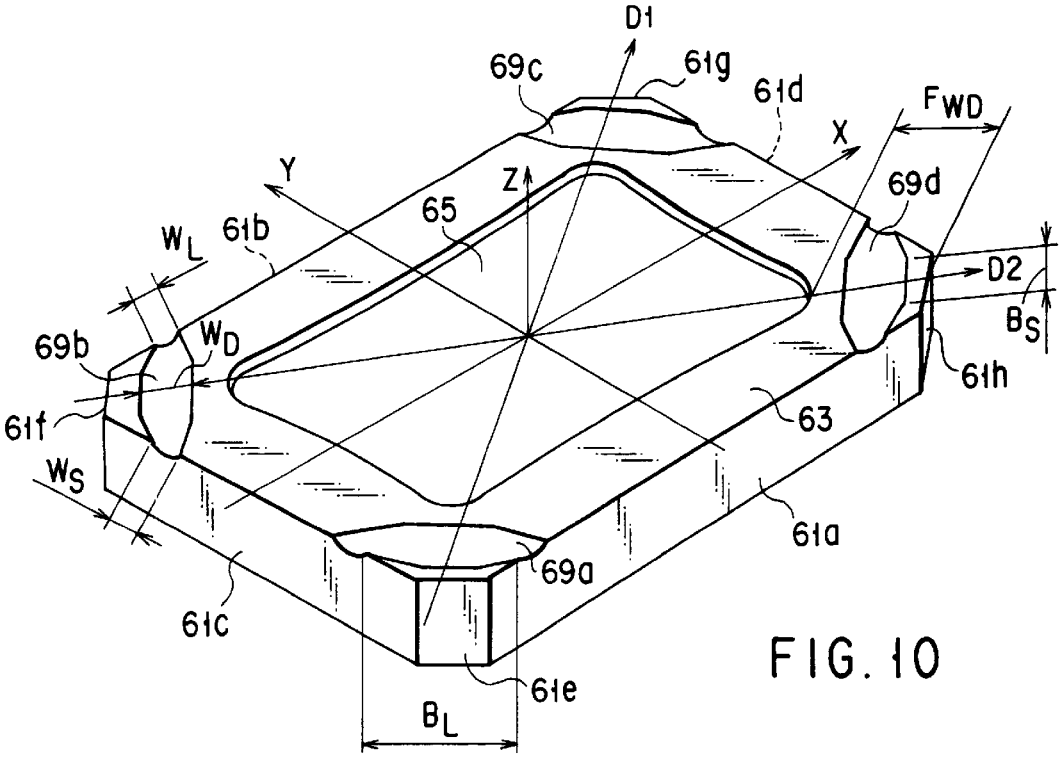
FIG. 10 is a perspective view schematically showing the construction of the base of a mask frame of a shadow mask assembly according to a further embodiment of the invention.

A modification of the third embodiment will now be described with reference to FIG. 10.

In this mask frame, as in the mask frame of the third embodiment shown in FIG. 9, substantially straight beads

69*a* to 69*d* are provided individually near the corners of the base portion 63. They continuously linearly connect the long sidewalls 61*a* and 61*b* and the short sidewalls 61*c* and 61*d*, with each corner sidewall 61*e* to 61*h* positioned between the long sidewall and the adjacent short sidewall. As shown in FIG. 11A, for example, the beads 69*a* to 69*d* have a U-shaped cross section.

The beads 69*a* to 69*d* are formed so that the bead width WD near the diagonal axis D1 (D2) is greater than a bead width WL on the long sidewalls 61*a* and 61*b* and a bead width WS on the short sidewalls 61*c* and 61*d*. The bead width WD near the diagonal axis is greater than the other widths. The frame strength can be improved more effectively by adjusting the width WD to about ½ of a diagonal portion width FWD of the base portion 63. In this modification, the bead widths WL and WS are substantially the same minimum width of 15 mm, for example, and the bead width WD is a maximum width of 23 mm, for example. In this case, the diagonal portion width FWD of the base portion 63 is 46 mm, for example. The depth of the deepest portion of each bead is 2 mm. In this modification, moreover, a length BS of that portion of each bead which has the maximum width WD in the longitudinal direction is adjusted to about ½ of a length BL of the whole bead in the longitudinal direction. For example, the length BL of the whole bead in the longitudinal direction is 74.3 mm, while the length BS of the maximum-width portion of the bead in the longitudinal direction is 30 mm.

In this modification, as in the third embodiment described above, satisfactory rigidity can be secured with the same effect.

In the first to third embodiments described herein, the cross section of each bead is U-shaped, as shown in FIG. 11A, rectangular, as shown in FIG. 11B, or L-shaped, as shown in FIG. 11D. Alternatively, however, it may be triangular, as shown in FIG. 11C. Alternatively, moreover, each bead may be formed by combining these sectional shapes with the same result.

It is to be understood that the depth, width, and length of the beads according to each of the embodiments described above may be suitably changed in consideration of the shape, size, weight, etc. of the frame.

According to the mask frame of each of the embodiments of the present invention described above and the color cathode ray tube provided with the same, the substantially straight beads are formed continuously linearly connecting the long and short sidewalls on the base of the mask frame, with each corner sidewall positioned between the long sidewall and the adjacent short sidewall. Thus, the mechanical strength of the mask frame can be improved, and the torsional rigidity can be secured without increasing the weight.

Further, the amplitude of the mask body that is welded to the mask frame can be controlled by controlling the amplitude of resonance of the mask frame that is caused by vibration transmitted when a speaker is operated with the color cathode ray tube mounted in a TV set.

According to the color cathode ray tube of the present invention, the mask frame and the mask body can be restrained from being deformed by external impact that is applied during processes for manufacturing and transporting the color cathode ray tube. Accordingly, the shadow mask can be prevented from being dislocated with respect to the panel.

Thus, the phosphor screen and the shadow mask can be kept in appropriate relative positions, and the color cathode ray tube is subject to only minor deterioration of color purity.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube comprising:

a vacuum envelope including a panel having a major axis and a minor axis perpendicular to each other;

a phosphor screen located on the inner surface of the panel;

an electron gun assembly for emitting electron beams toward the phosphor screen; and a color sorting mechanism opposed to the phosphor screen, the color sorting mechanism including a mask body, having a rectangular effective portion with a large number of electron beam holes, and a mask frame fixedly fitted with the mask body, the mask frame including a sidewall portion, composed of a pair of long sidewalls extending parallel to the major axis and opposed to each other, a pair of short sidewalls extending parallel to the minor axis and opposed to each other, and corner sidewalls between the long and short sidewalls, and a base portion extending from the sidewall portion toward a tube axis, the base portion having substantially straight beads located near the corner sidewalls and connecting the long and short sidewalls.

2. A color cathode ray tube according to claim 1, wherein the extending directions of said beads are not perpendicular to the diagonal axes of the mask frame.

3. A color cathode ray tube according to claim 1, wherein each said bead is formed having a substantially uniform width in the longitudinal direction thereof.

4. A color cathode ray tube according to claim 1, wherein each said bead is formed so as to be continuous with another bead in at least one of the long and short sidewalls.

5. A color cathode ray tube according to claim 1, wherein each said corner sidewall has a flat surface.

6. A color cathode ray tube according to claim 5, wherein said flat surface of each said corner sidewall is provided with an elastic supporter capable of engaging a stud pin on the panel.

7. A color cathode ray tube according to claim 1, wherein said panel has a substantially flat outer surface.

8. A color cathode ray tube according to claim 1, wherein each said bead is wider in the region near the diagonal axis of the mask frame than on the long and short sidewalls.

9. A color cathode ray tube according to claim 8, wherein each said bead has a maximum width near the diagonal axis corresponding thereto.

10. A color cathode ray tube according to claim 9, wherein the maximum width of each said bead is substantially equal to ½ of the width along the diagonal axis at the base portion.

11. A color cathode ray tube according to claim 9, wherein the length of that portion of each said bead which has the maximum width in the extending direction thereof is substantially equal to ½ of the length of the whole bead in the extending direction thereof.

12. A mask frame comprising:

a sidewall portion in the form of a rectangular frame including a pair of long sidewalls opposed to each other, a pair of short sidewalls opposed to each other, and corner sidewalls between the long and short sidewalls; and a base portion extending from the sidewall portion toward the center of the rectangular frame, the base portion having substantially straight beads located near the corner sidewalls and connecting the long and short sidewalls.

13. A mask frame according to claim 12, wherein the extending directions of said beads is not perpendicular to the diagonal axes of the mask frame.

14. A mask frame according to claim 12, wherein each said bead is formed having a substantially uniform width in the longitudinal direction thereof.

15. A mask frame according to claim 12, wherein each said bead is formed so as to be continuous with another bead in at least one of the long and short sidewalls.

16. A mask frame according to claim 12, wherein each said corner sidewall has a flat surface.

17. A mask frame according to claim 12, wherein each said bead is wider in the region near the diagonal axis of the mask frame than on the long and short sidewalls.

18. A mask frame according to claim 17, wherein each said bead has a maximum width near the diagonal axis corresponding thereto.

19. A mask frame according to claim 18, wherein the maximum width of each said bead is substantially equal to ½ of the width along the diagonal axis at the base portion.

20. A mask frame according to claim 18, wherein the length of that portion of each said bead which has the maximum width in the extending direction thereof is substantially equal to ½ of the length of the whole bead in the extending direction thereof.

* * * * *